United States Patent [19]

Zimmermann

[11] 4,112,639

[45] Sep. 12, 1978

[54] SHELL SILO

[75] Inventor: Adolf Zimmermann, Osterburken, Fed. Rep. of Germany

[73] Assignee: AZ0-Maschinenfabrik Adolf Zimmermann, Germany

[21] Appl. No.: 770,018

[22] Filed: Feb. 18, 1977

[30] Foreign Application Priority Data

Feb. 19, 1976 [DE] Fed. Rep. of Germany ..... 2606582

[51] Int. Cl.[2] ..... E04H 7/30

[52] U.S. Cl. ..... 52/174; 52/584

[58] Field of Search ..... 52/192, 193, 194, 195, 52/196, 197, 584, 282; 214/17 R, 17 A; 222/185

[56] References Cited

U.S. PATENT DOCUMENTS

| | | | |
|---|---|---|---|
| 1,112,952 | 10/1914 | Watkins | 52/629 X |
| 1,125,070 | 1/1915 | Daviee | 52/584 |
| 1,585,931 | 5/1926 | Mahee | 52/197 X |
| 1,754,516 | 4/1930 | Johnson | 52/194 |
| 2,953,276 | 9/1960 | Dunn | 52/584 X |
| 2,975,227 | 3/1961 | Wiater et al. | 52/282 X |
| 3,127,960 | 4/1964 | Smith et al. | 52/282 X |
| 3,248,024 | 4/1966 | Keathly | 52/194 X |
| 3,327,870 | 6/1967 | Fairchild, Jr. | 52/282 X |
| 3,729,876 | 5/1973 | Kolozsvary | 52/584 X |

FOREIGN PATENT DOCUMENTS

| | | | |
|---|---|---|---|
| 404,278 | 6/1966 | Australia | 52/197 |
| 553,154 | 12/1956 | Belgium | 52/194 |
| 2,434,314 | 1/1976 | Fed. Rep. of Germany | 52/584 |
| 849,828 | 7/1949 | Fed. Rep. of Germany | 52/194 |
| 719,988 | 11/1966 | Italy | 52/584 |

*Primary Examiner*—Leslie Braun
*Attorney, Agent, or Firm*—Craig & Antonelli

[57] ABSTRACT

A shell silo is supported with its bottom stage clear of the ground by means of support legs which are secured to flanges integral with the longitudinal edges of shell sections. The legs are secured in this way to at least the bottom stage and, where there are three or more stages or rings, also to the third stage, the sections of alternate stages being aligned with one another. The legs may be formed of a hollow cross-section member having a projecting strip or flange through which the connection to the flange of the shell section is made, and a separated backing strip may also be provided.

4 Claims, 2 Drawing Figures

SHELL SILO

The invention relates to a shell silo, comprising a plurality of superimposed stages each comprising a plurality of shell sections, which is erected by means of ground support legs and wherein each shell section has an integral flange at its longitudinal edges and is connected either positively or by locking engagement with the flange of a neighboring shell section.

Shell silos are distinguished from other silos by economy of space in storage and transportation and easy assembly of the individual shell sections to form the silo. Such shell silos also are capable of being installed on site under difficult space conditions and especially in constricted spaces.

If the product contained in the silo is to be withdrawn upwardly or sideways the silo can be set up directly upon the ground, which is not possible for downward withdrawal. In such a case the silo may be mounted upon a frame, which usually consists of several support legs and a support ring for the lowest stage of the bottom of the silo. This frame must, in the case of a silo of large capacity, be further stiffened by cross struts. Alternatively, it is possible to assemble the silo upon a cylindrical hollow casing, itself similar to a silo stage. The casing must then, however, have apertures for the discharging equipment and a manhole.

The invention takes as its basic purpose the provision of a shell silo with ground clearance, whose structural design renders it economically attractive to produce and which is easy to erect even in restricted space conditions.

This problem is solved by the invention in that the support legs are secured to the flanges of at least the bottom stage of the silo.

The flanges extending along the generatrices of the shell silo transmit the weight to the support legs. Horizontal cross forces therefore do not arise, so that the cross stiffening, which would otherwise be necessary, can be omitted. Moreover, no special supporting rings or the like are necessary. The silo requires no special preparations for its construction.

If the silo comprises three or more superimposed stages and the shell sections of each alternate stage or ring are aligned with each other, then the support legs can be secured to the flanges of the lowest stage and the third stage. It has been found that by attachment of the support legs to the flanges an exceptional degree of stability is achieved, even with silos of several tons capacity, and practically any conceivable weight can be accommodated.

For reasons of simplicity of assembly, the shell sections of shell silos are frequently connected together by means of screws at the erection site, these screws penetrating the adjacent flanges. In accordance with a preferred feature of the present invention, these screws also serve for securing the support legs to the shell sections. Consequently, no separate means are necessary for mounting the support legs. On the contrary, the support legs are integrated into the connection of the individual shell sections, so that the transmission of force to the support legs takes the most direct path. Instead of using screw connections it is obviously also possible to employ welded connections.

Preferably the support legs have a longitudinal flange, whose width and length correspond substantially to the width and length of the flanges of the shell sections, so that the longitudinal flange upon the support legs can engage between circumferentially extending flanges of the shell sections which are usually present, and can be brought into position to overlap those flanges of the shell sections which extend along the generatrices of the shell sections. If the support legs are formed of a hollow cross-section member, the flange may be in the form of an outwardly projecting strip, which is secured to the support leg, for example by welding.

An embodiment of the invention will now be described, by way of example, with reference to the accompanying drawings, in which.

Figure 1:
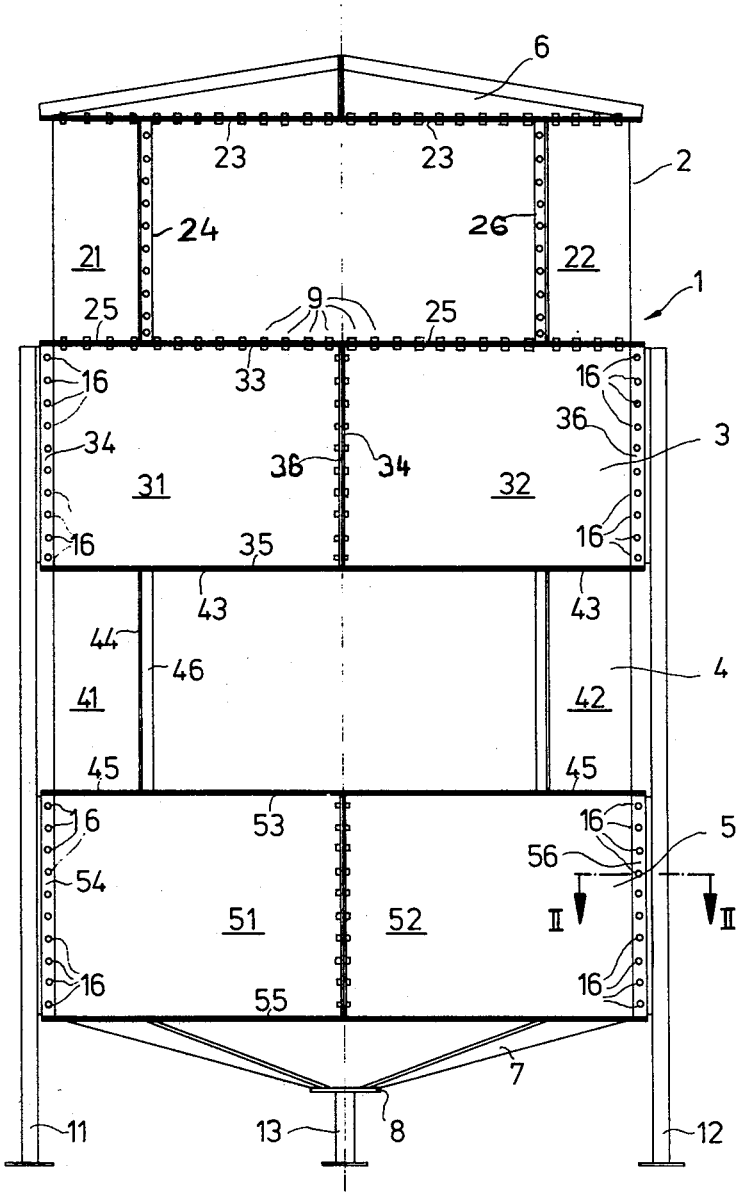
FIG. 1 is a side elevation of a shell silo.

The shell silo 1 shown in FIG. 1 comprises four stages 2, 3, 4 and 5, a roof 6 and a floor 7 having a discharge flange 8. In the practical example here shown each silo stage comprises four shell sections of quarter-cylindrical shape, of which several shell sections 21, 22; 31, 32; 41, 42; 51, 52 are visible in the drawing. The shell sections could of course have a larger subtending angle, for example 120°. Each shell section has its longitudinal and transverse edges bent to form flanges 23, 24, 25 and 26, and 33, 34, 35 and 36, respectively. The longitudinal flanges 24, 26 of neighboring shell sections 21, 22, and the transverse flanges 25, 33 of superimposed shell sections 21, 22 and 31, 32, are connected together by means of screws 9, some of which are shown in the drawing. Between the interconnected flanges there may be interposed a packing 10 (FIG. 2), particularly if the shell silo 1 is to be under positive pressure or negative pressure.

The shell silo 1 stands with ground clearance upon four support legs 11, 12, 13, the fourth support leg at the front being omitted for clearness of the drawing. If the shell sections are one-third-cylindrical, then only three support legs will be used. The support legs 11, 12, 13 are secured to the third stage 3 and to the first, namely the lowest or bottom stage 5.

Figure 2:
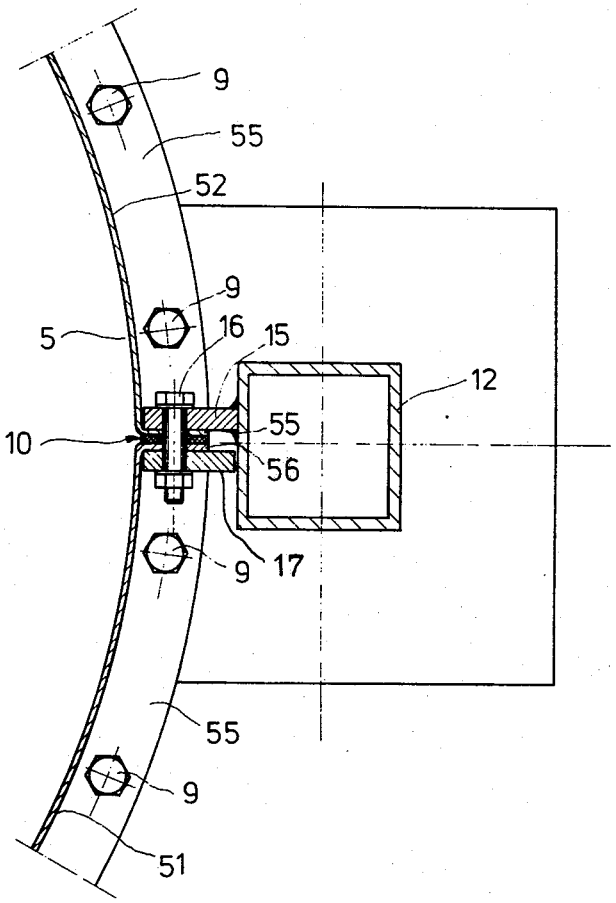
FIG. 2 is a section taken on II—II of FIG. 1.

The securing of the support legs 11, 12 is effected to the longitudinal flanges 34, 36 of the third shell sections 31, 32, and to the longitudinal flanges 54, 56 of the bottom shell sections 51, 52. In the practical example here shown, the support legs are formed of hollow quadrangular cross-section members, as can be seen in FIG. 2, to which is welded a strip 15, whose length and width corresponds substantially to those of the longitudinal flanges. This strip 15 is secured to the flanges 55, 56 by means of screws 16, which at the same time serve for connecting together the flanges. In addition a backing strip 17 may be provided.

What is claimed is:

1. Shell-type silo consisting of several superimposed stages, stabilizer legs attached to said stages, each stage being formed from several arcuate shells, said shells having a flange along each of the longitudinal edges of said shells substantially radially thereof and being connected by screws to the flanges of respective circumferentially adjacent shells, and a sealing means inter-posed between the flanges of said adjacent shells, characterized in that each of the stabilizer legs are provided with a single longitudinal flange that extends radially with respect to the silo, the width of which corresponds approximately to the width of the flanges of the shells, and which is attached to circumferentially adjacent flanges of the shells of at least the lowermost panel by means of the screws joining the flanges of the shells together.

2. Shell-type silo according to claim 1, characterized in that the stabilizer legs are fashioned as a hollow profile, the longitudinal flange being attached to the outside of this hollow profile.

3. Shell-type silo according to claim 2, characterized in that a connecting strip is associated with the longitudinal flange at the stabilizer legs.

4. A shell silo according to claim 1, comprising at least three superimposed shell stages, wherein the support legs are secured to the flanges of the shell sections of the bottom stage and of the second from the bottom stage.

* * * * *